United States Patent [19]

Kleine

[11] 4,243,113

[45] Jan. 6, 1981

[54] DRILLING HEAD OF A ROTARY IMPACT DRILL

[75] Inventor: Werner Kleine, Achim, Fed. Rep. of Germany

[73] Assignee: Gebruder Heller Verwaltungsgesellschaft mit beschrankter Haftung, Achim-Uphausen, Fed. Rep. of Germany

[21] Appl. No.: 12,575

[22] Filed: Feb. 15, 1979

[30] Foreign Application Priority Data

Feb. 20, 1978 [DE] Fed. Rep. of Germany ..... 2807197

[51] Int. Cl.[3] ..... E21B 10/38

[52] U.S. Cl. ..... 175/410; 175/320; 175/417

[58] Field of Search ..... 175/213, 320, 410, 418, 175/417

[56] References Cited

U.S. PATENT DOCUMENTS

| | | | |
|---|---|---|---|
| 3,163,246 | 12/1964 | Vagins et al. | 175/410 |
| 3,434,553 | 3/1969 | Weller | 175/410 |
| 3,434,554 | 3/1969 | Bowers, Jr. | 175/410 |

FOREIGN PATENT DOCUMENTS

| | | | |
|---|---|---|---|
| 806039 | 4/1936 | France | 175/410 |

*Primary Examiner*—William F. Pate, III

*Attorney, Agent, or Firm*—Thomas R. Morrison

[57] ABSTRACT

An exhaust channel in a rock drilling head of a rotary impact drill has an opening which extends over the front face of the drill shaft and over the adjoining peripheral surface of the drill shaft. Clogging of the exhaust channel is prevented by providing clearances between the forward and peripheral surfaces of the drilling head and the bored hole which are too small to permit the passage of rock particles large enough to block the exhaust channel.

10 Claims, 2 Drawing Figures

DRILLING HEAD OF A ROTARY IMPACT DRILL

BACKGROUND OF THE INVENTION

The present invention relates to a drilling head for a rotary impact drill. Rotary impact drills are also known as hammer drills, center drills and core bits.

Impact drills are employed for drilling holes in rock or concrete by axially reciprocating the drill while rotating it such that a hardened cutting member at the end thereof fractures and pulverizes the rock before it. In order to prevent cushioning of the blow of the drill on the rock, it is desirable to remove the particles of rock from before the end of the drill. One way of accomplishing this is to provide an exhaust channel axially disposed in the shaft of a drill and a connection bore from the exhaust channel to a location near the cutting member.

One of the problems with exhaust channels is that their external openings tend to become clogged with larger particles of crushed rock. In addition, in order to prevent internal clogging, exhaust channels should not become narrower than their openings but instead should, if possible, effectively widen in order to prevent clogging at a constricted point.

Due to the requirement for a connecting bore from the exhaust channel to the vicinity of the cutting member, rotary impact drills of the prior art require larger diameter shafts than are desired. Otherwise, the strength of the drilling head is sufficiently impaired in the vicinity of the cutting member that it is not capable of absorbing impact forces arising during drilling.

OBJECTS AND SUMMARY OF THE INVENTION

It is accordingly an object of the present invention to provide a rotary impact drill which avoids the problems of the prior art.

It is a further object of the invention to provide a drilling head of a rotary impact drill which is minimally impaired by the presence of a connecting bore.

The above and other objects of the invention are accomplished by providing a drilling head for a rotary impact drill for producing drilled holes in rock comprising a drill shaft having a peripheral surface and an end face, a cutting member affixed in the end face and protruding axially a predetermined distance therefrom, and having a cutting edge extending diametrically at least over the end face, an exhaust bore in the drill shaft, a connecting bore between the exhaust bore and an opening in a surface of the drilling head, an axis of the connecting bore forming an acute angle with an axis of the exhaust bore, and the opening extending over the end face and an adjoining portion of the peripheral surface.

The fact that the opening of the connecting bore extends partially across the adjacent peripheral surface of the drilling head and is radially limited on one side by the wall of the connecting bore and on the other side by the wall of the drilled hole provides an inner diameter greater than the inner diameter of the connecting bore. Because the connecting bore forms an acute angle with the exhaust bore, the wall of the connecting bore opposite the wall of the drill hole also forms an acute angle with the wall of the drill hole. As a result, the maximum radial distance between the wall of the connecting bore and the wall of the drill hole continuously enlarges in the exhaust direction. It is especially advantageous that the connecting bore be cylindrical since cylindrical bores are easier to produce than expanding tapered bores.

As a result of the present invention, the head of a rotary impact drill can be produced in significantly smaller bore diameters than in the prior art. According to the present invention, drills can be produced having diameters as small as six millimeters.

The above and other objects, features and advantages of the present invention will become apparent from the following detailed description read in conjunction with the accompanying drawings in which like numerals designate the same elements.

DETAILED DESCRIPTION OF THE PREFERRED EMBODIMENT

Figure 1:
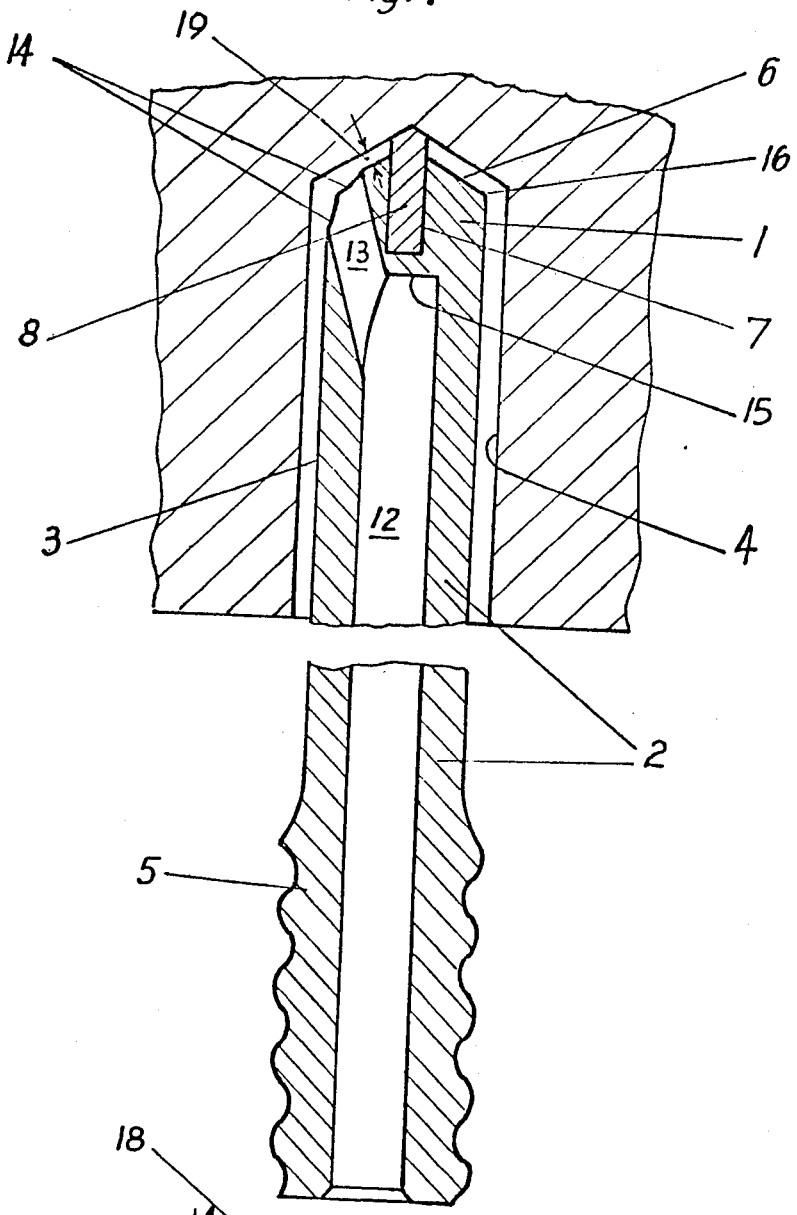
FIG. 1 shows a cross sectional view of a drilling head shown in a bored hole taken along lines I—I in FIG. 2 according to an embodiment of the invention.
Figure 2:
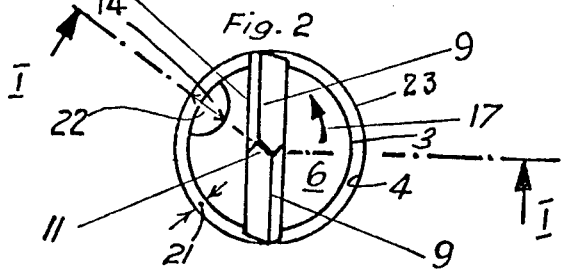
FIG. 2 is an end view of the drill shown in FIG. 1.

Referring to FIGS. 1 and 2, a drilling head 1 located at the end of a drill shaft 2 has a transverse slit 7 therein into which is affixed a hardened cutting member 8.

A cylindrical axial exhaust bore 12 is provided in the drill shaft 2 and terminates at an inner end 15 short of the bottom of the slit 7. The outer peripheral surface 3 of drill shaft 2 is smoothly cylindrical over the operating length of the drill. At the end of the drill remote from the cutting edge, threads 5 may be provided for screwing into the chunk of a drilling machine (not shown).

A connecting bore 13 whose axis makes an acute angle with the axis of axial exhaust bore 12 connects axial exhaust bore 12 with an opening 14 which is located partly in the peripheral surface 3 of drill shaft 2 and partly on the tapering end face 6 of drilling head 1. In addition, the inner end of connecting bore 13 joins axial exhaust bore 12 in such a way that the cross section of the inner end 15 of axial exhaust bore 12 overlaps at least half of the cross section of connecting bore 13 which lies in the plane of the cross section of inner end 15. This ensures that the inner end of connecting bore 13 extends freely into axial exhaust bore 12 without possibility of constriction.

Referring momentarily to FIG. 2, the drill rotates in the direction shown by arrow 17. A leading edge 18 of the cutting member is thereby defined. Cutting edges 9 extend from the center of the cutting member to the radial extremities and are joined at the center by a transverse cutting edge 11. Cutting edges 9 extend beyond the radial extremities of end face 6 to define a cutting track 23 which provides a radial clearance 21 between the peripheral surface 3 and drilled hole 4 (FIG. 1). Opening 14 is located advantageously adjacent leading edge 18 since this location least weakens the structure of drilling head 1.

In order to positively prevent clogging of opening 14, the radial distance 22 from the edge of opening 14 to drilled bore 4 is larger than the distance 19 (FIG. 1) between tapering end face 6 and the end of drilled bore 4. The size of distance 19 is controlled by the amount of protrusion of cutting member 8 beyond tapering end face 6. For a similar reason, and also to make it possible to use the drill as a center drill for a core bit, radial clearance 21 is also smaller than radial distance 22.

Since connecting bore 13 opens radially outward from opening 14, a relatively enlarged opening 14 results without impairing the strength of drilling head 1 in the vicinity of cutting member 8.

Having described a specific preferred embodiment of the invention with reference to the accompanying drawings, it is to be understood that the invention is not limited to this precise embodiment, and that various changes and modifications may be effected therein by one skilled in the art without departing from the scope or spirit of the invention as defined in the appended claims.

What is claimed is:

1. A drilling head for a rotary impact drill for producing drilled bores in rock comprising:

(a) a drill shaft having a cylindrical peripheral surface and an end face;

(b) a cutting member affixed in said end face, said cutting member protruding axially a predetermined axial distance beyond said end face, said cutting member having at least one cutting edge thereon;

(c) said cutting edge extending generally diametrically along said cutting member and having at least one radial outer end protruding radially beyond said peripheral surface, a radial extreme of said at least one radial outer end defining a cutting track, said cutting track being at a radial distance from said peripheral surface;

(d) an exhaust bore in said drill shaft;

(e) a connecting bore between said exhaust bore and an opening in a surface of said drilling head;

(f) said opening having a rim extending over a portion of said end face and an adjoining portion of said peripheral surface, a point of said rim of said opening having a largest radial distance from said cutting track which exceeds the distance of said radial outer end of said cutting edge from said peripheral surface; and (g) said axial distance of said cutting edge from said end face being smaller than said largest radial distance of said point of said rim from said cutting track of said radial outer end of said cutting edge.

2. A drilling head according to claim 1, wherein said connecting bore is cylindrical.

3. A drilling head according to claim 2, wherein said end face is tapering.

4. A drilling head according to claim 1, wherein said opening is adjacent a leading edge of said cutting member.

5. A drilling head according to claim 3, wherein said end face is conical.

6. A drilling head according to claim 1, wherein more than half of said opening is located in said peripheral surface.

7. A drilling head according to claim 6, wherein said exhaust bore is a blind bore, said cutting member is affixed in a slit in said end face, said exhaust bore has an inner end being axially spaced from said slit, said connecting bore entering said inner end in such a manner that a cross section of said inner end overlaps at least half of a cross section of the connecting bore lying in the plane of this cross section.

8. A drilling head according to claim 2, wherein said distance of said cutting track from said peripheral surface is smaller than said diameter of said connecting bore.

9. A drilling head according to claim 1, wherein at least one cutting edge includes a first cutting edge on said cutting member extending radially in a first direction from a center of said cutting member, a second cutting edge on said cutting member extending radially in a direction opposite to said first direction from said center of said cutting member, said first and second cutting edges being laterally offset from each other, and a transverse cutting edge joining inner ends of said first and second cutting edges.

10. A drilling head according to claim 1, wherein both ends of said cutting member protrude radially beyond said peripheral surface.

* * * * *